US006696967B1

(12) United States Patent
Rutter et al.

(10) Patent No.: US 6,696,967 B1
(45) Date of Patent: Feb. 24, 2004

(54) AMBIENT CONDITION ALARM FOR CONNECTING TO A LIGHT FIXTURE

(76) Inventors: Nicholas Alexander Rutter, The TechnoCentre, Puma Way, Coventry (GB), CV1 2TT; Simon Paul Tate, The TechnoCentre, Puma Way, Coventry (GB), CV1 2TT ( * ) Notice: Subject to any disclaimer, the term of this patent is extended or adjusted under 35 U.S.C. 154(b) by 0 days.

(21) Appl. No.: 09/555,972

(22) PCT Filed: Oct. 7, 1999

(86) PCT No.: PCT/GB99/03326

§ 371 (c)(1),
(2), (4) Date: Jun. 6, 2000

(87) PCT Pub. No.: WO00/21047

PCT Pub. Date: Apr. 13, 2000

(51) Int. Cl.[7] ..... G08B 17/10

(52) U.S. Cl. ..... 340/632; 340/628; 340/629; 340/693.6; 340/693.9; 340/693.12

(58) Field of Search ..... 340/632, 628, 340/629, 286.05, 527, 691.1, 693.5, 539, 531, 693.6, 693.9, 693.12; 219/448.11, 413, 448.12

(56) References Cited

U.S. PATENT DOCUMENTS

| | | | | | |
|---|---|---|---|---|---|
| 4,072,933 | A | * | 2/1978 | Pun | 340/632 |
| 4,139,770 | A | * | 2/1979 | Beyersdorf | 250/381 |
| 4,757,303 | A | * | 7/1988 | Scheidweiler | 340/501 |
| 4,812,827 | A | * | 3/1989 | Scripps | 340/693 |
| 4,827,247 | A | * | 5/1989 | Giffone | 340/630 |
| 4,839,562 | A | * | 6/1989 | Francis et al. | 315/149 |
| 5,432,500 | A | * | 7/1995 | Scripps | 340/628 |
| 5,705,979 | A | * | 1/1998 | Fierro et al. | 340/517 |
| 6,078,269 | A | * | 6/2000 | Markwell et al. | 340/825.5 |
| 6,150,936 | A | * | 11/2000 | Addy | 340/539 |

* cited by examiner

*Primary Examiner*—Toan Pham
(74) *Attorney, Agent, or Firm*—Mitchell Silberberg & Knupp LLP

(57) ABSTRACT

Provided is an alarm for detecting radiation, smoke and/or other air pollutants and includes detection means, first means for connection to a light fitting, and second means for connection to a light source. Electrical connection means connects the first means and the second means to enable the light source to be powered from the light fitting. In addition, a battery powers the alarm during periods of non-use of the light source, and isolating means thermally isolates the detection means from at least one of the electrical connection means, the light fitting and the light source.

14 Claims, 6 Drawing Sheets

Temperature compensation for the smoke detector IC.

$R1 := 80000$ $R2 := 1045000$ $R3 := 1125000$

R1,R2, and R3 are the values for the on board Voltage divider in the MC145017

$$Iqic := \left(\frac{9}{R1 + R2 + R3}\right)$$

The normal current due to the voltage divider Is 4uA (at 9v supply ) when strobed $$Iqic := 4 \cdot 10^{-6}$$

$$R6 := 470 \cdot 10^{3}$$

$$R7 := 220 \cdot 10^{6}$$

R5 is the value of the thermistor and a parallel Resistance, R6 is the thermistor varying from 1M at 10C ,to 470k at 25C ,to 150k at 50C. R7 is the fixed parallel resistance.

R8 is a resistor in the series with R5

$$R5 := \frac{(R6 \cdot R7)}{(R6 + R7)}$$

$$R8 := 0.68 \cdot 10^{6}$$

$$R4 := R5 + R8$$

$$R9 := 2.2 \cdot 10^{6}$$

$$R10 := \frac{(R3 \cdot R9)}{(R3 + R9)}$$

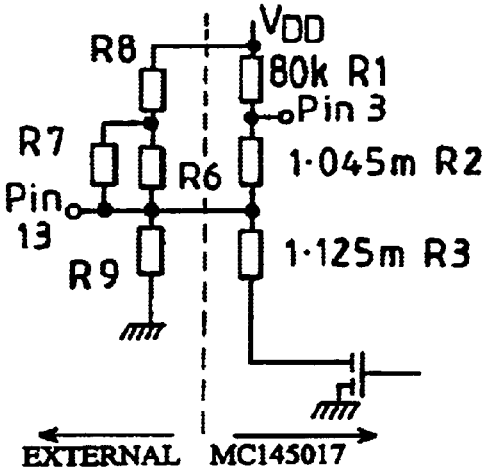

$$Vsense := \left[\frac{9}{\left[R1 + R9 + \left[\frac{(R2 \cdot R4)}{(R2 + R4)}\right]\right]}\right] \cdot R10$$

Vsense + 4.884 volts $$Iq := \frac{9}{\left[R1 + R9 + \left[\frac{(R2 \cdot R4)}{(R2 + R4)}\right]\right]}$$

The compensation network has now added R9 which is not power strobed , and allows a continuos current drain from the supply. This has the value of Iq $$Iq := 3.183 \cdot 10^{-6} \text{ A}$$

FIG 9

Values for V sense are R6=150K 5.2v
R6=1M 4.56v

AMBIENT CONDITION ALARM FOR CONNECTING TO A LIGHT FIXTURE

FIELD OF THE INVENTION

The present invention relates to an alarm and particularly, but not exclusively, to an alarm for detecting radiation and/or air pollutants such as smoke, carbon monoxide, radon and the like.

BACKGROUND OF THE INVENTION

One disadvantage associated with existing alarms is that they normally require fixing, using screws or the like, to the ceiling of a room and there is a tendency for users to put off the effort of doing this, sometimes with disastrous consequences.

A further disadvantage is that since such alarms are normally fitted to room ceilings, if the alarm is tripped accidentally the alarm can only be reset by actuating a reset switch which is actually on the alarm and is therefore difficult to access. A result of this is that there is a tendency for users to remove batteries from alarms which are accidentally tripped relatively frequently, again sometimes with disastrous results.

SUMMARY OF THE INVENTION

The present invention seeks to provide an improved alarm.

Accordingly, there is provided an alarm for detecting radiation and/or air pollutants such as smoke, carbon monoxide or the like, the alarm having:

detection means;

fast means for connection to a light fitting;

second means for connection to a light source; and electrical connection means for connecting said first means and said second means to enable said light source to be powered from said light fitting.

The present invention also provides an alarm for detecting radiation and/or air pollutants such as smoke, carbon monoxide or the like, connectable in a lighting circuit and having control means responsive to the energising and de-energising of said lighting circuit a preset number of times over a preset time period to apply a reset signal to said alarm thereby to reset said alarm in the event of an accidental triggering thereof.

The present invention also provides an alarm system for a building for detecting radiation and/or air pollutants such as smoke, carbon monoxide or the like, said system comprising:

a plurality of alarms, each alarm being connectable in a lighting circuit; and means for enabling each said alarm to communicate with the other alarms in said system thereby to allow testing resetting and/or triggering of each alarm in response to testing, resetting and/or triggering of only one of said alarms.

The present invention further provides a alarm for detecting radiation and/or air pollutants such as smoke, carbon monoxide or the like, the alarm having:

detection means;

first means for connection to a socket of a power circuit;

second means for connection to an electrical appliance; and electrical connection means connecting said first and second means to enable said electrical appliance to be powered from said power circuit.

The present invention is further described hereinafter, by way of example, with reference to the accompanying drawings, in which:

BRIEF DESCRIPTION OF DRAWINGS

FIG. 9 is a circuit diagram of a sensitivity adjustment circuit for the alarm.

DESCRIPTION OF THE INVENTION

In the below-described embodiment, the invention is described in relation to a smoke alarm. It will be appreciated, however, that the invention is equally applicable to an alarm for detecting other air pollutants such as carbon monoxide, radon or the like, or any forms of radiation.

Figure 3:
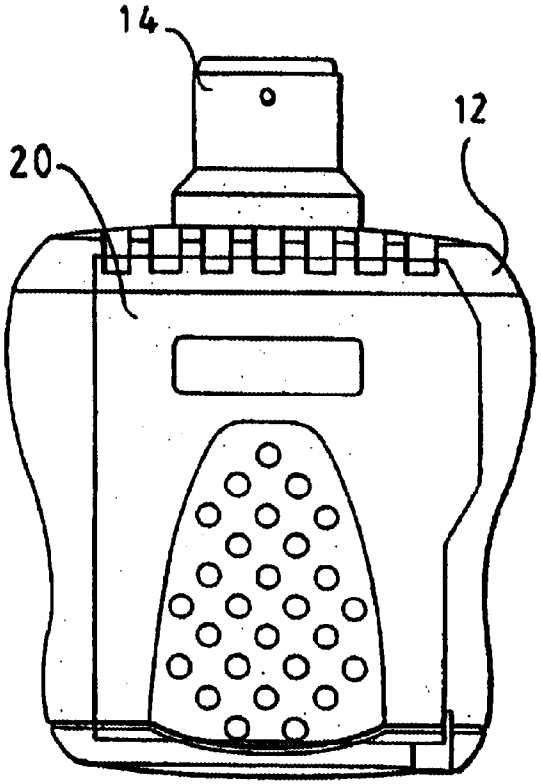
FIG. 3 is a further side elevation of the alarm of FIG. 1 as seen in the direction of arrow B of FIG. 2.
Figure 2:
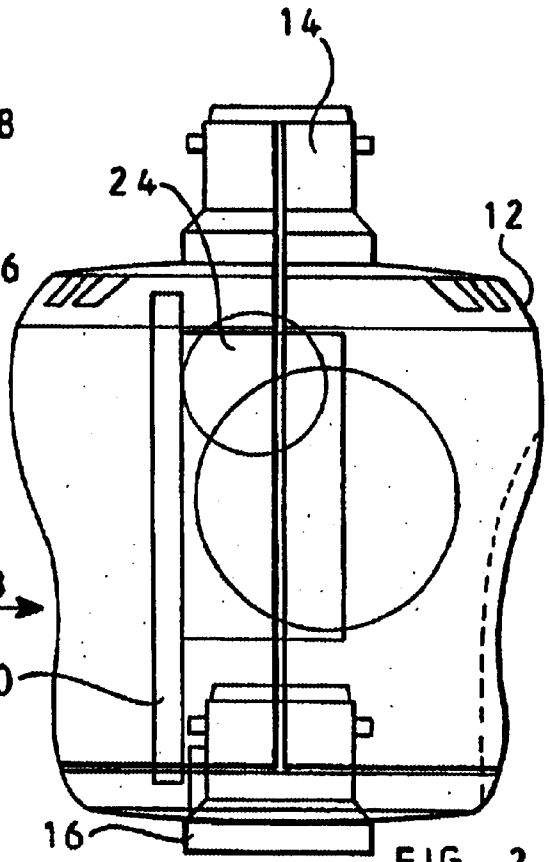
FIG. 2 is a side elevation of the alarm of FIG. 1 viewed in the direction of arrow A.
Figure 1:
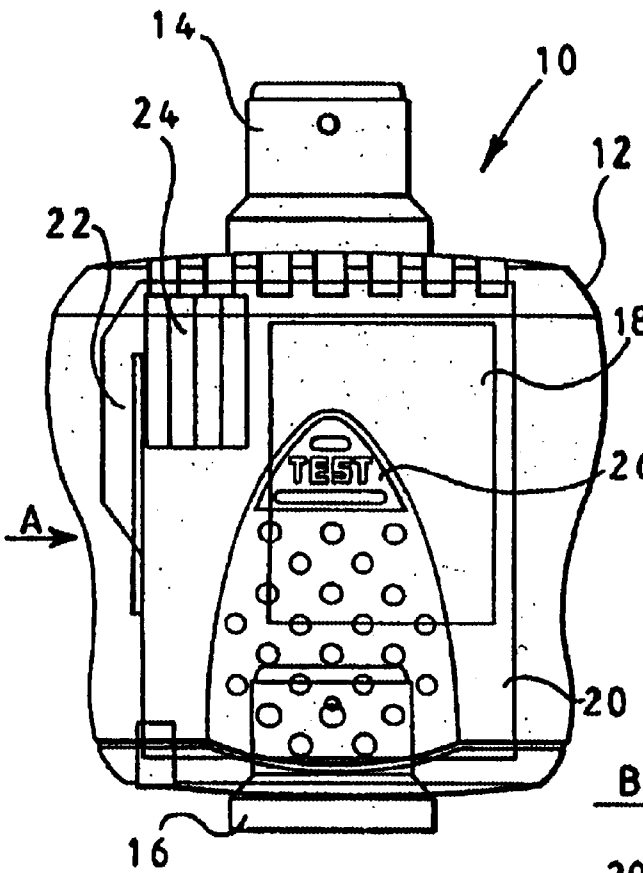
FIG. 1 is a side elevation of a preferred form of alarm according to the present invention.

FIGS. 1 to 3 of the drawings show a preferred form of smoke alarm 10 which has a housing 12 carrying a male bayonet fitting 14 at one axial end and a female bayonet fitting 16 at the other axial end. The housing is generally circular in cross-section although any suitable shape of housing may of course be used. The bayonet fittings, 14, 16 are shown axially aligned and whilst this is the preferred alignment it will be appreciated that the smoke alarm may have more than one female bayonet fitting 16 to accommodate several lights, in which case they would not be axially aligned with the male bayonet fitting 14 but would normally be equi-angularly spaced about the axis.

The male bayonet fitting 14 is intended for plugging into a suitable light fitting such as a conventional female bayonet fitting suspended from a ceiling rose whilst the bayonet fitting 16 is intended to receive a conventional light bulb. Whilst the fittings 14, 16 are shown as bayonet fittings it will be appreciated that any suitable fitting,s could be used such as, for example, screw-thread fittings or indeed a combination where the male fitting 14 may be a screw-thread fitting with the female fitting 16 being a bayonet fitting and vice versa.

The housing 12 contains an ionisation chamber 18 and the main circuitry 20 of the smoke alarm. A piezoelectric buzzer 22 is provided as the audible alarm and power is supplied from a rechargeable battery 24, such as a lithium battery. A test button 26 is also provided for testing the smoke alarm. The bayonet fittings 14, 16 are interconnected by power supply lines (not shown) which allow a light bulb connected to the fitting 16 to be operated normally from a remote light switch. However, the conventional circuitry of the smoke alarm also includes a charging circuit shown in FIG. 4 which, whilst the light fitting is energised, powers the smoke alarm circuit and charges the rechargeable battery 24. It will be appreciated, therefore, that since the mains power to the alarm is provided by the "switched" live connection, no mains power will be supplied to the smoke alarm during periods when the lighting circuit is switched off. During such times, the smoke alarm is powered by the rechargeable battery 24.

Figure 4:
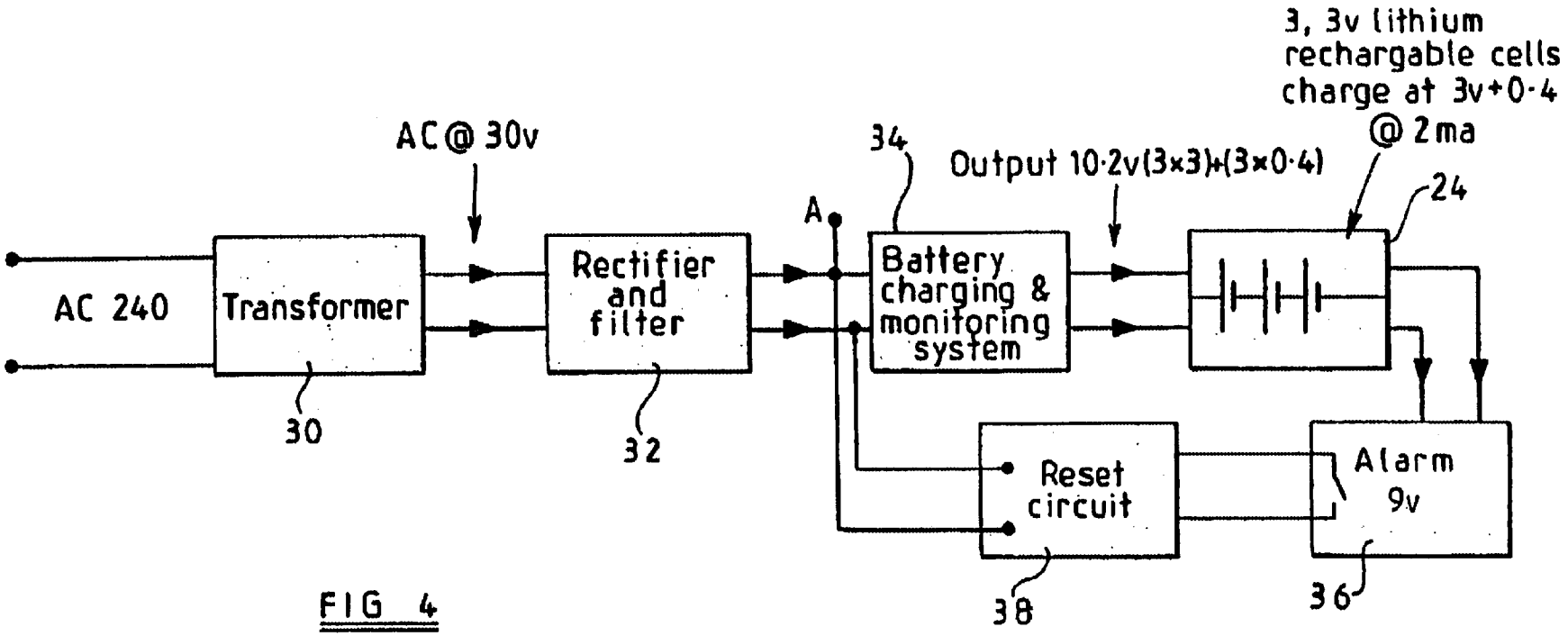
FIG. 4 is a block circuit diagram of a charging circuit for the alarm.

The charging circuit of FIG. 4 has a transformer 30 connected to the power lines passing through the housing 12. The transformer 30 provides a 30v AC supply which is rectified and filtered by a rectifier/filter unit 32 and applied to a battery charging and monitoring circuit 34. This in turn applies a charging signal of typically 10.2 volts to the battery 24 to charge the battery.

The battery in turn powers the smoke alarm circuit 36.

Alternatively, the battery may be a conventional, non-rechargeable battery. In either case, the alarm could be powered by the battery when the lighting circuit is off and by the mains supply when the lighting circuit is on. Otherwise, the battery could power the alarm at all times.

A reset circuit 38 is also provided for the smoke alarm circuit. This is a typically conventional circuit which is present on most smoke alarms. This circuit is also connected to the rectifier/filter unit 32 which provides power for the circuit 38.

Figure 5:
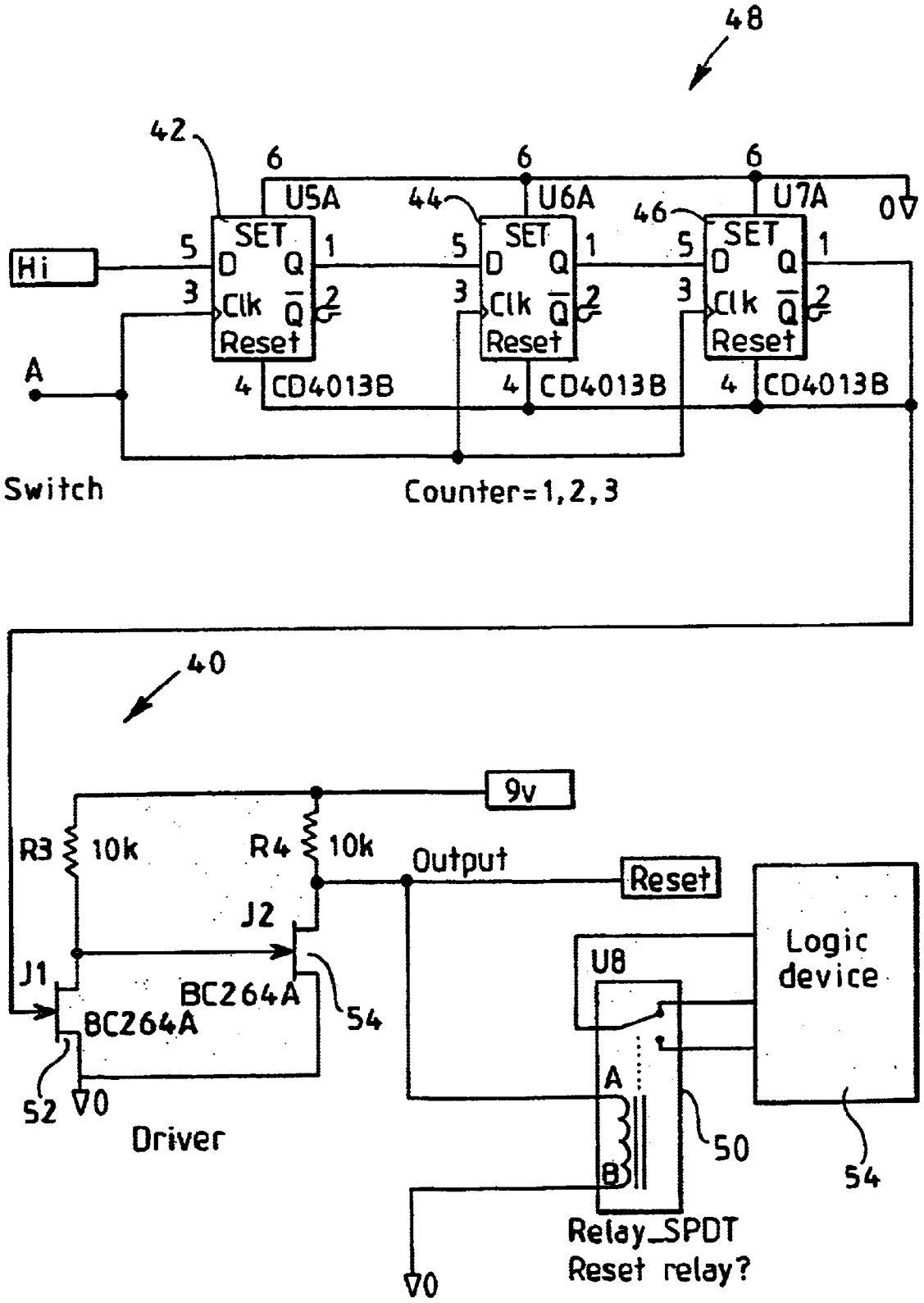
FIG. 5 is a circuit diagram of a reset circuit for the alarm.

Referring now to FIG. 5, this shows a control circuit 40 which can be used to reset the smoke alarm. The circuit 40 has three flip-flops 42, 44, 46 which are arranged to provide an output which is high in response to three input pulses on terminal three of the first flip-flop 42. Terminal three is connected to the output of the rectifier and filter unit 32 whilst terminal five of the flip-flop 42 is held high. The effect of this is that if the light switch providing power to the transformer 30 is flicked on and off rapidly three times the output of the counter circuit 48 formed by the flip-flops 42, 44, 46 goes high.

The output of the counter circuit 48 drives a relay 50 through a pair of MOS field effect transistors 52, 54, the relay in turn applying a reset signal to a logic device 54 which may be included in the reset circuit 38 or external to the reset circuit 38 and controlling the reset circuit in order to reset the alarm 36. As an alternative to the relay 50, the output of transistor 54 could be applied directly to the reset circuit 58 in order to reset the alarm.

Whilst three "flicks" of the light switch arm used to reset the alarm, it will be appreciated that this number may be varied and the time period during which the "flicks" must be effected can also be varied. In addition, a different number of "flicks" of the light switch could be used, through the logic device 54, to test the alarm or to perform an alternative function such as a change of mode of the alarm, for example to detect a different pollutant such as carbon monoxide.

As an alternative to the circuit of FIG. 5 being actuated via a direct electrical signal from the charging circuit, it could be effected by way of a signal generated by a light sensor tripped by rapid ON and OFF switching of the light bulb.

Where several smoke alarms according to the present invention are used in a number of different light fittings they can be interconnected by way of an RF link. This would enable the resetting or testing of one, for example, to reset and/or test all of the smoke alarms which are so linked. This also enables an alarm which is triggered on detection of smoke to trigger other alarms via the RF link.

Alternatively, a number of alarms may communicate with each other by means of the mains neutral cable to which each alarm is connected or by other means such as sonic signals.

In a further embodiment of smoke alarm according to the present invention, an escape light can be included in the housing of the alarm.

The smoke alarm according to the present invention can also be included as an integral part of strip lighting or any other type of lighting. It may, for example, be combined with a normal light source such as a light bulb so as to be connected into a standard bayonet or screw fitting. Locking means may be provided on or associated with the male bayonet or screw fitting for locking the alarm into the light fitting such that it may be unplugged from the fitting only by use of an appropriate tool such as a key or the like. This may prevent accidental disconnection of the alarm when replacing a light bulb, or the theft of a unit The alarm may be built integrally within a ceiling rose or strip light fitting or even as an addition to track lighting. In this last case the smoke alarm need not be connected to a light source such as a light bulb but can be independently connected into the track lighting in the same mane as a conventional lighting connection.

Where the alarm is set to switch on a light in response to triggering of the alarm, the light can be a halogen or track light of low, DC voltage.

It will be appreciated that during normal operation of the lighting circuit to which the alarm is connected, the bulb and the bayonet fitting may become relatively hot. It is common for the bayonet fitting in conventional lighting circuits to reach, or even exceed, temperatures of around 160° C. It is possible for the heat generated by the bulb and the bayonet fitting to be transmitted, either by convection or conduction, through the housing 12 and to the main circuitry 20.

Such heating of the main circuitry may compromise the efficiency or operation of the circuitry and this is particularly relevant to the rechargeable battery 24 which powers the circuitry. It can be shown, that the life of such a rechargeable battery decreases as the battery temperature rises. It is essential, therefore, that the main circuitry, and particularly the battery, is prevented from becoming overheated due to the high temperatures of the bulb and the bayonet fitting.

Figure 6:
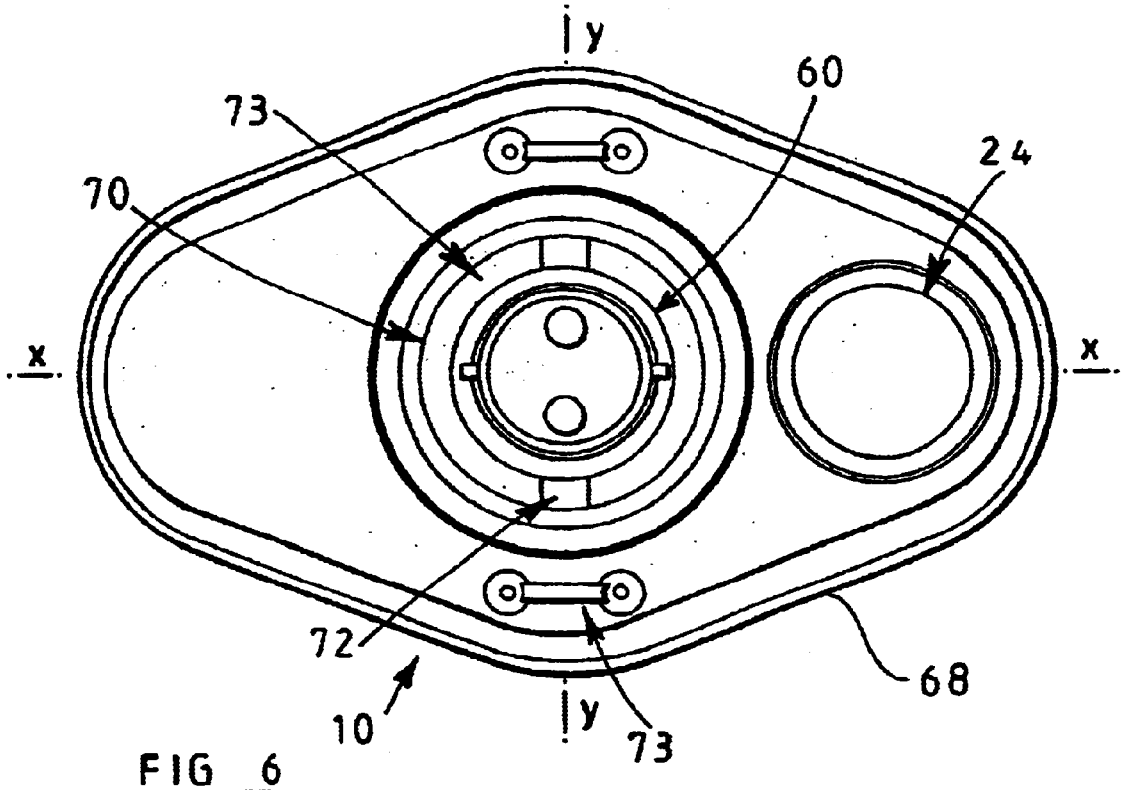
FIG. 6 is a plan view of an alternative form of alarm according to the invention.
Figure 7:
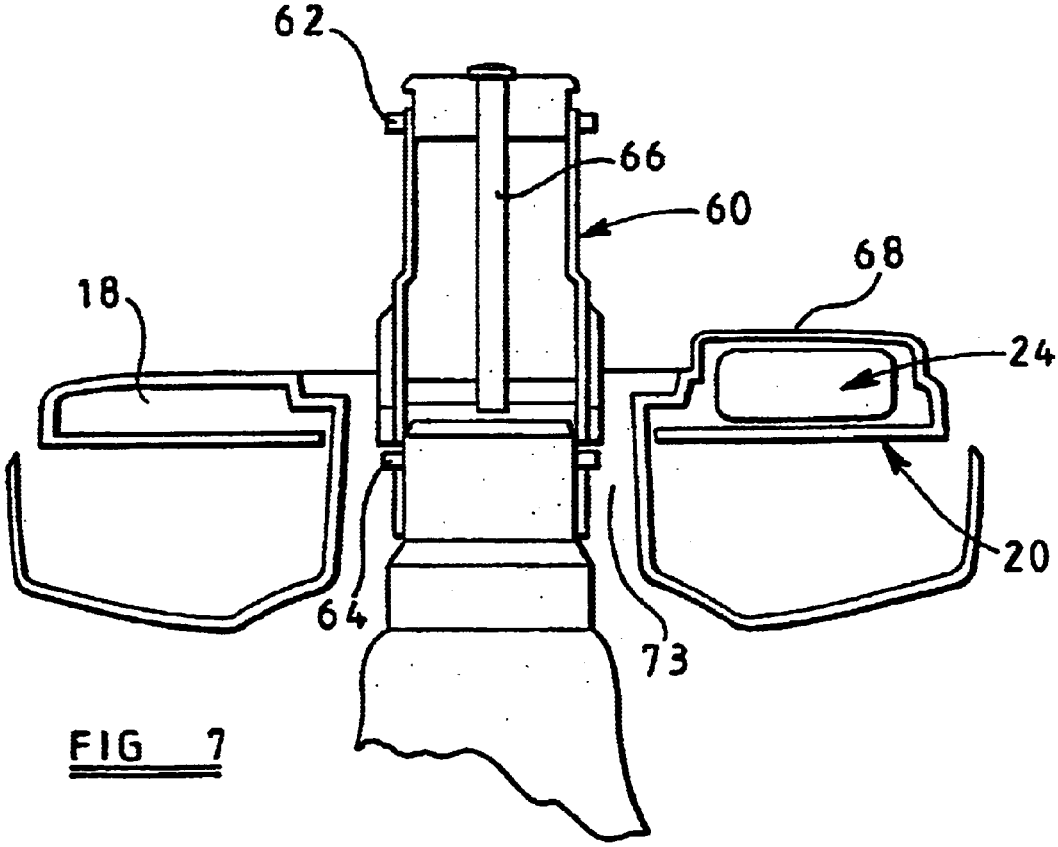
FIG. 7 is a sectional view along the line x—x of the alarm of FIG. 6.
Figure 8:
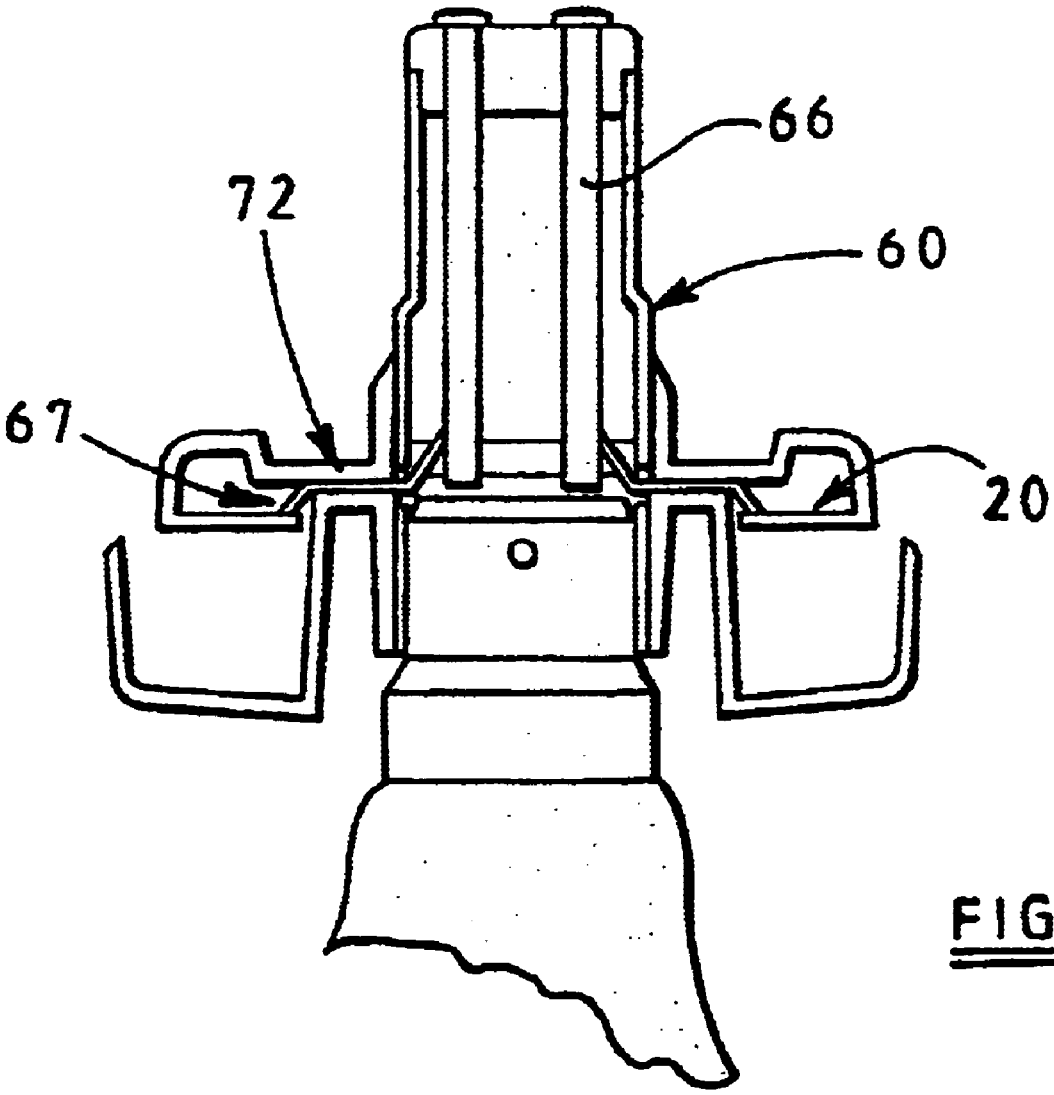
FIG. 8 is a sectional view along the line y—y of the alarm of FIG. 6.

It is preferable, therefore, to provide in the smoke alarm a means for isolating the main circuitry 20 and the battery 24 from the heat generated by the bulb and the bayonet fitting. Referring to FIGS. 6–8, these show another embodiment of the present invention incorporating such isolating means.

In this embodiment, the smoke alarm 10 has a core structure 60 in the form of a generally cylindrical tube 60. The tube 60 has a male bayonet fitting 62 at one axial end and a female bayonet fitting 64 at the other axial end. As in the previous embodiment, the male bayonet fitting 62 is plugged into a conventional female bayonet fitting suspended from a ceiling rose and the female bayonet fitting 64 receives a conventional light bulb. The bayonet fittings 62, 64 are interconnected by power supply lines 66 which run axially within the tube 60.

The tube 60 is preferably formed from a material having good thermal conductivity, for example copper or aluminium. This allows any heat generated in the bayonet fittings to be dispersed evenly along the length of the tube.

The alarm 10 has a main housing 68 which, in this embodiment, has a cross-section being substantially elliptical and which houses the ionisation chamber 18 and the main circuitry 20 of the smoke alarm. The housing 68 has a central aperture 70 which is of a greater diameter than the diameter of the tube 60. The alarm 10 is arranged such that the man housing 68 surrounds the tube 60 with the tube extending through the centre of the aperture 70. The housing 68 is spaced from, and connected to, the external surface of the tube 70 by means of one or more connecting legs 72, thereby providing an annular air gap 73 between the housing and the tube. In this embodiment, there are two connecting legs which are diametrically opposed across the aperture 70, although it will be appreciated that more than two legs can be used.

The connecting legs 72 are preferably of a material having a low thermal conductivity, such as a plastics material, and in addition are preferably hollow so as to enable them to carry cables 67 to supply electrical power, tapped from the power cables 66, to the main circuitry 20 of the smoke alarm.

It will be appreciated that this embodiment provides a thermally isolating air gap 73 between those parts of the apparatus which arc liable to be subjected to high temperatures, such as the bulb and the bayonet fittings, and the main circuitry 20 and the battery 24. This air gap allows heat to be convected away from these parts and reduces the heating of the main housing, and thus the battery and the main circuitry 20.

It will be appreciated that the isolation gap 73 provided between the tube 60 and the main housing 68 may be filled with a thermally insulating material, such as fibreglass or the like which may be wrapped around the tube 60 along either all or part of its length. Alternatively, the isolating gap may be made larger by increasing the diameter of the aperture and increasing the length of the connecting legs 72 which would allow both a thermally insulating material to be wrapped around the tube 60 and still retain an air gap between the insulating material and the main housing 68. Obviously, the greater the isolating gap, the less heat will be conducted or convected to the main circuitry.

As a further modification, the smoke alarm of the present invention, being interposed between the ceiling rose and the bulb results in the bulb hanging somewhat lower than usual. If a conventional lamp shade is used, the bulb may hang slightly below the lower rim of the lampshade. This is undesirable for many people for aesthetic reasons. The smoke alarm of the present invention may therefore be provided with attachment means for hanging a conventional lampshade directly from the main housing of the alarm.

In FIG. 6, the attachment means comprises two supports 74 located on the upper surface of the main housing 68 on either side of the aperture 70. Each support 74 comprises two spaced apart, vertical pins connected by a cross bar such that each support takes the form substantially of a letter "H". The supporting arms of the conventional lampshade therefore rest on the supports which lowers the level of the lampshade such that the relative positions of the bulb and the lampshade are approximately that of a conventional lampshade/bulb arrangement. This additionally allows a greater flow of air through the annular isolation gap 73.

During manufacture of the alarm, it is often the case that the battery supplied by the manufacturer may have a low charge. The alarm of the present invention is provided with circuitry which generates an audible warning from the buzzer 22 when the charge of the battery falls below a certain level if the battery provided by the manufacturer already contains a low charge, during shipping of the unit it is possible that the audible low charge warning is constantly generated. This can be inconvenient and can further reduce the charge on the battery. It is preferable, therefore, to provide means for disconnecting, for example, the buzzer or the battery, from the circuitry during shipping. This may be achieved, for example, by providing a strip of non-conducting material such as polythene between either the buzzer or the battery and the circuit board. An end of the strip of non-conducting material projects out of the main housing of the alarm such that it can be pulled and withdrawn from between the buzzer and the circuit board prior to, or just after, insertion of the alarm into the ceiling rose light fitting. Once the alarm has been plugged into the light fitting, the lighting circuitry can be switched on such that a trickle charge is provided to the battery as described earlier, thereby to charge to the battery.

An external sensitivity adjustment which is variable in discrete steps or continuously may also be provided on the alarm. Alternatively, to further reduce the degrading effect of heat on the performance and effectiveness of the main circuitry 20, in particular the detection circuitry, the sensitivity of the circuitry may be automatically adjustable such that as the temperature of the circuitry rises, its sensitivity is increased. Thus any degradation in the performance of the detection circuitry is substantially compensated for by an increase in detector sensitivity.

The automatic adjustment in the sensitivity of the circuitry may be achieved by using, for example, the circuit of FIG. 9 which includes a thermistor (R6 in FIG. 9) having a large negative thermal coefficient of resistance.

In a further embodiment of the invention the smoke alarm may have a housing which carries a male fitting for engagement in a co-operating socket of a power circuit such as a domestic power circuit, and a female fitting for receiving a co-operating plug of an electrical appliance. Internal connection means within the housing would connect the two fittings together in order to allow power to flow from the power circuit to the electrical appliance when these are connected via the smoke alarm. The construction of the smoke alarm would be similar to that shown in FIGS. 1 to 3 with the exception that the fittings would be of a sufficiently high rating for the power circuit.

The invention is not limited to a smoke alarm and is equally applicable to an alarm for detecting methane, carbon monoxide, radon, heat or the like.

What is claimed is:

1. An alarm for detecting radiation, smoke, and/or other air pollutants, comprising:

detection means;

first means for connection to a light fitting;

second means for connection to a light source;

electrical connection means for connecting said first means and said second means to enable said light source to be powered from said light fitting;

a battery for powering the alarm during periods of non-use of said light source; and isolating means for thermally isolating said detection means and said battery from at least one of said electrical connection means, said light fitting and said light source.

2. An alarm according to claim 1 having housing means for housing said detection means and said electrical connection means.

3. An alarm according to claim 2 wherein said isolating means comprises a tubular core structure having said first means at one end thereof and said second means at the other end thereof and wherein said housing means is arranged spaced from and surrounding said core to provide a gap between said housing means and said core.

4. An alarm according to claim 3 wherein said gap contains a material having low thermal conductivity.

5. An alarm according to claim 3 wherein said housing means is supported on said isolating means by a plurality of connecting legs being formed of a material having a low thermal conductivity.

6. An alarm according to claim 3 wherein said tubular core structure is formed of a material having a high thermal conductivity, such as copper.

7. An alarm according to claim 1 wherein during periods of use of said light source, the alarm is powered by said light fitting.

8. An alarm according to claim 1 wherein said battery is a rechargeable battery and the alarm includes charging means coupled to said electrical connection means for charging said battery.

9. An alarm according to claim 1 having control means responsive to the energising and de-energising of said light source a preset number of times over a preset time period to apply a reset signal to the alarm, thereby to reset said alarm in the event of an accidental triggering thereof.

10. An alarm according to claim 1 having means for testing said alarm.

11. An alarm according to claim 10 wherein said means for testing comprises switch means on said housing means.

12. An alarm according to claim 10 wherein said means for testing comprises control means responsive to energising and de-energising of said light source a preset number of times over a preset period to apply a test signal to the alarm thereby to test said alarm.

13. An alarm according to claim 1 having means for disabling said alarm during periods of non-use.

14. An alarm according to claim 1 having means for adjusting the sensitivity of the alarm in response to a change in ambient conditions.

* * * * *